US011657776B2

(12) United States Patent
Wang

(10) Patent No.: US 11,657,776 B2
(45) Date of Patent: May 23, 2023

(54) DRIVING METHOD AND DRIVE CIRCUIT OF DISPLAY PANEL

(71) Applicant: HKC CORPORATION LIMITED, Shenzhen (CN)

(72) Inventor: Mingliang Wang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 292 days.

(21) Appl. No.: 17/042,113

(22) PCT Filed: Dec. 13, 2018

(86) PCT No.: PCT/CN2018/120831
§ 371 (c)(1),
(2) Date: Sep. 26, 2020

(87) PCT Pub. No.: WO2020/113646
PCT Pub. Date: Jun. 11, 2020

(65) Prior Publication Data

US 2021/0012745 A1 Jan. 14, 2021

(30) Foreign Application Priority Data

Dec. 3, 2018 (CN) ..... 201811465418.4

(51) Int. Cl.
*G09G 3/36* (2006.01)

(52) U.S. Cl.
CPC ..... *G09G 3/3696* (2013.01); *G09G 2310/08* (2013.01); *G09G 2320/0233* (2013.01);
(Continued)

(58) Field of Classification Search
CPC ..... G09G 3/3696; G09G 2310/08; G09G 2320/0233; G09G 2320/0238;
(Continued)

(56) References Cited

U.S. PATENT DOCUMENTS

2009/0278866 A1* 11/2009 Kim ..... G09G 3/20 345/213
2011/0057915 A1* 3/2011 Sheu ..... G09G 3/3611 345/211

(Continued)

FOREIGN PATENT DOCUMENTS

CN 102013238 A 4/2011
CN 103474016 A 12/2013

(Continued)

OTHER PUBLICATIONS

English translation for CN 103474016, Inventor Shunming, Assignee Qingdao Hisense Electric CO (Year: 2013).*

(Continued)

*Primary Examiner* — William Boddie
*Assistant Examiner* — Saifeldin E Elnafia

(57) ABSTRACT

The present application discloses a driving method and a drive circuit of a display panel. The driving method includes the following steps: according to the distance from the data driving chip, the display panel is divided into a plurality of charging regions in advance, each charging area is provided with a unique digital code, and the corresponding information of the charging area and the digital code is stored in the timing control chip in advance; detecting a charging area where the pixel to be charged is located, and outputting a corresponding digital code according to the charging area by a timing control chip; the gamma chip receives the digital code and generates a gamma voltage corresponding to the digital code according to the input operating voltage to drive charging operation of the charging area corresponding to the digital code.

16 Claims, 3 Drawing Sheets

(52) U.S. Cl.
CPC ..... *G09G 2320/0238* (2013.01); *G09G 2320/0673* (2013.01)

(58) Field of Classification Search
CPC ..... G09G 2320/0673; G09G 3/20; G09G 3/3688; G09G 2310/027; G09G 2320/0686; G09G 2320/0276
See application file for complete search history.

(56) References Cited

U.S. PATENT DOCUMENTS

| | | | | |
|---|---|---|---|---|
| 2015/0022512 | A1* | 1/2015 | Ahn | G09G 3/3659 345/212 |
| 2015/0179103 | A1* | 6/2015 | Tani | G09G 3/20 345/690 |
| 2016/0196793 | A1 | 7/2016 | Xu | |

FOREIGN PATENT DOCUMENTS

| | | | |
|---|---|---|---|
| CN | 104293552 | A | 1/2015 |
| CN | 105388646 | A | 3/2016 |

OTHER PUBLICATIONS

Nan Yao, the ISA written comments,Sep. 2019, CN.
Nan Yao, the International Search Report, dated Sep. 2019, CN.

* cited by examiner

DRIVING METHOD AND DRIVE CIRCUIT OF DISPLAY PANEL

CROSS REFERENCE OF RELATED APPLICATIONS

This application claims the priority to the Chinese Patent Application No. CN201811465418.4, filed with National Intellectual Property Administration, PRC on Monday, Dec. 3, 2018 and entitled "DRIVING METHOD AND DRIVE CIRCUIT OF DISPLAY PANEL", which is incorporated herein by reference in its entirety.

TECHNICAL FIELD

The present application relates to the technical field of display, especially a driving method and a drive circuit of a display panel.

BACKGROUND

The statements herein merely provide background information related to the present application and do not necessarily constitute the conventional art.

With the development and advancement of science and technology, Liquid Crystal Display (LCD) has become the mainstream of display products due to its thin body, low power consumption and low radiation, and has been widely used. Most of the liquid crystal displays on the market are backlight liquid crystal displays, which include liquid crystal panels and backlight modules. The working principle of liquid crystal panels is to place liquid crystal molecules in two parallel glass substrates and apply driving voltage on the two glass substrates to control the rotation direction of the liquid crystal molecules, so as to refract the light of the backlight modules to generate a picture.

Thin Film Transistor-Liquid Crystal Display (TFT-LCD) has been playing a leading role in the display field because of its low power consumption, excellent picture quality and high yield. Likewise, the thin film transistor liquid crystal display includes a liquid crystal panel and a backlight module, the liquid crystal panel includes a color filter substrate (which is also called color filter substrate), thin film transistor substrate and mask, and the above substrate includes a transparent electrode on the opposite inner side. A layer of Liquid Crystal (LC) molecules are sandwiched between the two substrates.

With the increasing size and resolution of LCD TV, the difference will be minimized by two-sided drive of data line, but this method will bring great difficulty to the production line, and at the same time, it will double the data lines, resulting in a significant increase in manufacturing costs.

SUMMARY

The purpose of the present application is to provide a driving method and a drive circuit of a display panel, so as to solve the poor display effect of the display panel.

To achieve the above objective, the present application discloses a driving method of a display panel.

A driving method of a display panel, including:

according to the distance from the data driving chip, the display panel is divided into a plurality of charging regions in advance, each charging area is provided with a unique digital code, and the corresponding information of the charging area and the digital code is stored in the timing control chip in advance;

detecting a charging area where the pixel to be charged is located, and outputting a corresponding digital code according to the charging area by a timing control chip:

the gamma chip receives the digital code and generates a gamma voltage corresponding to the digital code according to the input operating voltage to drive charging operation of the charging area corresponding to the digital code.

Optionally, the display panel further includes an operating voltage circuit that generates the operating voltage; the gamma chip includes a reference voltage generation circuit and a gamma voltage generation circuit; the input terminal of the reference voltage generation circuit is coupled to the timing control chip and the operating voltage circuit respectively, and the input terminal of the gamma voltage generation circuit is coupled to the reference voltage generation circuit.

Optionally, the step that the gamma chip receives the digital code and generates a gamma voltage corresponding to the digital code according to the input operating voltage to drive charging operation of the charging area corresponding to the digital code includes:

the reference voltage generation circuit receives the digital code and generates a reference voltage corresponding to the digital code according to the input operating voltage.

Optionally, the step that the reference voltage generation circuit receives the digital code and generates a reference voltage corresponding to the digital code according to the input operating voltage includes:

the gamma voltage generation circuit receives a reference voltage and generates a gamma voltage corresponding to the digital code to drive charging operation of the charging area corresponding to the digital code.

Optionally, the step that the gamma voltage generation circuit receives a reference voltage and generates a gamma voltage corresponding to the digital code to drive charging operation of the charging area corresponding to the digital code includes:

the reference voltage generation circuit receives the digital code and multiplies the working voltage by the digital voltage to obtain the reference voltage.

Optionally, the step that the reference voltage generation circuit receives the digital code and multiplies the working voltage by the digital voltage to obtain the reference voltage includes:

the gamma voltage generation circuit receives the digital code and generates a gamma voltage corresponding to the digital code according to the reference voltage.

Optionally, the gamma chip further includes a gamma voltage division coefficient memory storing gamma voltage division coefficients;

the step that the gamma voltage generation circuit receives a reference voltage and generates a gamma voltage corresponding to the digital code to drive charging operation of the charging area corresponding to the digital code includes:

the gamma voltage generation circuit receives a reference voltage and generates a corresponding gamma voltage according to the corresponding gamma voltage division coefficient to drive charging operation of the charging area corresponding to the digital code.

Optionally, the first side and the second side of the display panel are provided with a data driving chip, which adopts a data line double-sided driving mode;

or only the first side or the second side of the display panel is provided with a data driving chip, which adopts a data line single-sided driving mode.

Optionally, the farther the charging area is away from the data driving chip, the larger the corresponding gamma voltage is.

Optionally, the display area of the display panel is sequentially divided into a plurality of charging areas according to the number of rows of data lines, and each charging area has a unique digital code.

Optionally, the step of detecting a charging area where the pixel to be charged is located, and outputting a corresponding digital code according to the charging area by a timing control chip includes:

The number of rows of counting data lines of the counter of the timing control chip;

optionally, the step that the number of rows of counting data lines of the counter of the timing control chip includes:

the timing control chip identifies the count value of the counter, and obtains and outputs the corresponding digital code from the memory.

Optionally, if the count value of the counter is greater than or equal to 100 and less than or equal to 200, a digital code 2 corresponding to 1.2 times standard gamma voltage is obtained.

Optionally, if the count value of the counter X is greater than or equal to 200 and less than or equal to 300, a numeric code 3 corresponding to 1.3 times standard gamma voltage is obtained.

Optionally, if the count value of the counter X is greater than or equal to 300 and less than or equal to 400, a numeric code 4 corresponding to 1.4 times standard gamma voltage is obtained.

The present application also discloses a driving method of a display panel, including:

According to the distance from the data driving chip, the display panel is divided into a plurality of charging areas in advance according to the number of rows of data lines, each charging area has a unique digital code, and the corresponding information of the charging area and the digital code is stored in the timing control chip in advance;

the number of rows of counting data lines of the counter of the timing control chip;

the timing control chip identifies the count value of the counter, and obtains and outputs the corresponding digital code from the memory;

the reference voltage generation circuit receives the digital code and generates a reference voltage corresponding to the digital code according to the input operating voltage of the operating voltage circuit;

the gamma voltage generation circuit receives a reference voltage and generates a corresponding gamma voltage according to the corresponding gamma voltage division coefficient to drive charging operation of the charging area corresponding to the digital code;

the farther the charging area is from the data driving chip, the larger the corresponding gamma voltage is.

The present application also discloses a driving circuit of a display panel, using the above driving method, which includes:

according to the distance from the data driving chip, the display panel is divided into a plurality of charging regions in advance, each charging area is provided with a unique digital code, and the corresponding information of the charging area and the digital code is stored in the timing control chip in advance;

detecting a charging area where the pixel to be charged is located, and outputting a corresponding digital code according to the charging area by a timing control chip;

the gamma chip receives the digital code and generates a gamma voltage corresponding to the digital code according to the input operating voltage to drive charging operation of the charging area corresponding to the digital code.

In the present application, the gamma voltage can be adjusted according to the charging difference of the charging area, and the darker charging area is given an actual gamma voltage higher than the standard gamma voltage, so that the lightness of the corresponding charging area is enhanced and the lightness difference with other areas is reduced or even eliminated. Further, the present application realizes the generation of different gamma voltages to different charging areas by supplying different reference voltages to the gamma voltage generation circuit; based on different reference voltages, the gamma voltage generation circuit generates different gamma circuits through the same circuit, thereby avoiding circuit changes caused by changing the structure of the gamma voltage generation circuit and upgrading the production line caused by circuit changes, so as to avoid an increase in generation cost.

BRIEF DESCRIPTION OF DRAWINGS

The accompanying drawings, which are included to provide an understanding of embodiments of the present application and constitute a part of the specification, illustrate embodiments of the application and, together with the text description, explain the principles of the application. Obviously, the drawings in the following description are merely some embodiments of the present application, and those skilled in the art can obtain other drawings according to the drawings without any inventive labor. In the drawings.

DETAILED DESCRIPTION OF EMBODIMENTS

Figure 1:
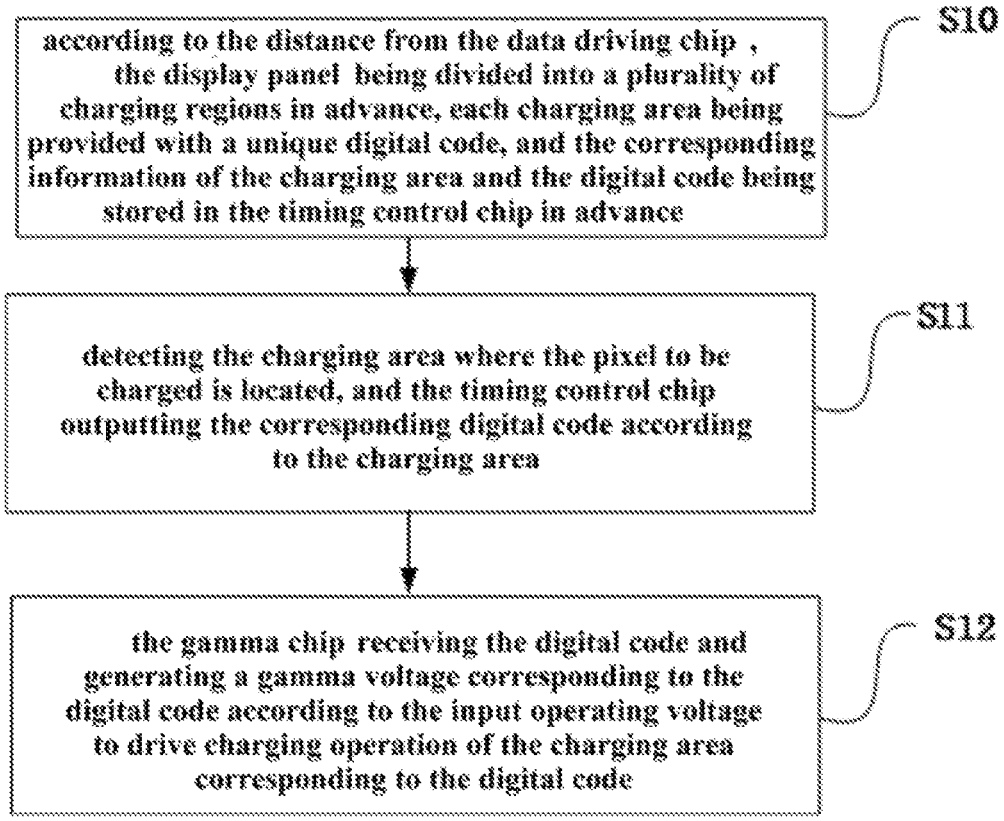
FIG. 1 is a schematic diagram of a driving method flow of a display panel in an embodiment of the present application.

The specific structural and functional details disclosed herein are merely representative and are illustrative of the exemplary embodiments of the present application. However, the present application may be embodied in many alternative forms and should not be construed as being limited only to the embodiments set forth herein.

In the description of the present application, it should be understood that, the terms "center", "horizontally", "up", "down", "left", "right", "vertical", "horizontal", "top", "bottom", "inner", "outer" and the like for indicating an orientation or positional relationship are based on the orientation or positional relationship shown in the accompanying drawings, and are intended solely to facilitate description and simplification of the description, and are not intended to indicate or imply that the device or element referred to must have a specific orientation, be constructed and operated in a specific orientation, and thus is not to be construed as limiting the present application. Further, the terms "first" and "second" are only for the purpose of description and are not to be construed as indicating or implying a relative importance or implicitly indicating the number of technical features indicated. Therefore, a feature defined as "first," and "second," may explicitly or implicitly include one or more of the features. In the description of the present application, "multiple" means two or more unless otherwise noted. In addition, the term "including" and any variations thereof are intended to cover non-exclusive inclusion.

In the description of the present application, it should be noted that, unless expressly specified and defined otherwise, the terms "mount", "attach" and "connect" are to be understood broadly, for example, it can be a fixed connection, a detachable connection, or an integral connection; it can be an either mechanical connection or an electrical connection; it can be a direct connection or an indirect connection through an intermediate medium, and can be an internal connection between two elements. For those skilled in the art, the specific meaning of the above terms in this application can be understood according to the specific circumstances.

The terms used herein are merely intended to describe specific embodiments and are not intended to limit the exemplary embodiments. Unless clearly indicated by the context otherwise, the singular forms "a" or "an" are intended to include the plural. It should also be understood that the terms "include" and/or "comprise" as used herein specify the presence of the features, integers, steps, operations, units and/or components set forth without excluding the presence or addition of one or more other features, integers, steps, operations, units, components and/or combinations thereof.

The present application will now be described by reference to the accompanying drawings and alternative embodiments.

As shown in FIGS. 1 to 4, the embodiment of the present application discloses a driving method of a display panel 100, including:

S10: according to the distance from the data driving chip 140, the display panel 100 being divided into a plurality of charging regions in advance, each charging area being provided with a unique digital code, and the corresponding information of the charging area and the digital code being stored in the timing control chip 110 in advance;

S11: detecting a charging area where the pixel to be charged is located, and outputting a corresponding digital code according to the charging area by a timing control chip 110;

S12: the gamma chip 120 receiving the digital code and generating a gamma voltage corresponding to the digital code according to the input operating voltage to drive charging operation of the charging area corresponding to the digital code.

As the size and resolution of the liquid crystal television become larger and higher, the charging difference between the proximal end and the distal end of the data line from the data driving chip 140 becomes more and more obvious when the data line charges the panel, lying in that the charging effect of the distal end is poor and the lightness is low, and the charging effect of the proximal end is good and the lightness is high. In the present scheme, the gamma voltage can be adjusted according to the charging difference of the charging area, and the darker charging area is given an actual gamma voltage higher than the standard gamma voltage, so that the lightness of the corresponding charging area is enhanced and the lightness difference with other areas is reduced or even eliminated. Further, the present scheme realizes the generation of different gamma voltages to different charging areas by supplying different reference voltages to the gamma voltage generation circuit 122; based on different reference voltages, the gamma voltage generation circuit 122 generates different gamma voltages through the same circuit, thereby avoiding circuit changes caused by changing the structure of the gamma voltage generation circuit 122 and upgrading the production line caused by circuit changes, so as to avoid an increase in generation cost.

In one or more embodiments, the display panel 100 further includes an operating voltage circuit 130 that generates the operating voltage; the gamma chip 120 includes a reference voltage generation circuit 121 and a gamma voltage generation circuit 122; the input terminal of the reference voltage generation circuit 121 is coupled to the timing control chip 110 and the operating voltage circuit 130 respectively, and the input terminal of the gamma voltage generation circuit 122 is coupled to the reference voltage generation circuit 121;

the step that the gamma chip 120 receives the digital code and generates a gamma voltage corresponding to the digital code according to the input operating voltage to drive charging operation of the charging area corresponding to the digital code includes:

the reference voltage generation circuit 121 receives the digital code and generates a reference voltage corresponding to the digital code according to the input operating voltage;

the gamma voltage generation circuit 122 receives a reference voltage and generates a gamma voltage corresponding to the digital code to drive charging operation of the charging area corresponding to the digital code.

In the present application, the reference voltage generation circuit 121 converts the input operating voltage into a reference voltage; the gamma voltage generate circuit 122 drives a gamma voltage output from a reference voltage; then, the reference voltage is also used as the reference voltage of the gamma voltage generation circuit 122, and all the gamma voltages are obtained by dividing the reference voltages, so that the magnitude of the reference voltage is changed, and different magnitudes of the gamma voltages are obtained. This method is simple and easy to operate, without changing or adding other devices, and reduces the difficulty of production.

In one or more embodiments, the reference voltage generation circuit 121 receives the digital code and multiplies the working voltage by the digital voltage to obtain the reference voltage;

the gamma voltage generation circuit 122 receives the digital code and generates a gamma voltage corresponding to the digital code according to the reference voltage.

In the present application, the gamma voltage is obtained by dividing the reference voltage. Now we can amplify the operating voltage that produces the reference voltage. Then, a reference voltage larger than the original can be obtained, so that a gamma voltage larger than the original can be obtained to compensate the voltage of the charging area, so that the lightness of the charging area with darker lightness can be improved, and the lightness and darkness phenomenon between the proximal end and the distal end of the data line can be reduced or even be eliminated.

The digital encode can be determined according to actual requirements and the lightness difference of the display panel. For example, when the reference voltage is obtained by voltage division, the digital code can be made smaller than or equal to 0, but the charging area farther from the data driving chip has the larger gamma voltage, and the corresponding digital code is larger.

In an embodiment, the gamma chip 120 further includes a gamma voltage division coefficient memory 123 storing gamma voltage division coefficients;

the step that the gamma voltage generation circuit 122 receives a reference voltage and generates a gamma voltage corresponding to the digital code to drive charging operation of the charging area corresponding to the digital code includes:

the gamma voltage generation circuit 122 receives a reference voltage and generates a corresponding gamma voltage according to the corresponding gamma voltage division coefficient to drive charging operation of the charging area corresponding to the digital code.

In this scheme, according to different gamma voltage division coefficients, different magnitudes of gamma voltage division are performed to obtain corresponding digital code and gamma voltage under lightness requirements, and under the same other conditions, if the charging area is farther away from the data driving chip, the corresponding gamma voltage is larger. The gamma voltage division coefficient memory 123 stores a large number of gamma voltage division coefficients, which can be provided at the gamma chip to reduce the pressure of cross-board data transmission.

In one or more embodiments, the first side and the second side of the display panel 100 are provided with a data driving chip 140, which adopts a data line double-sided driving mode:

or only the first side or the second side of the display panel 100 is provided with a data driving chip 140, which adopts a data line single-sided driving mode.

The scheme can be applied to the data line unilateral drive architecture, so that the technical difficulty caused by the double-side drive mode of the data line and the production difficulty caused by the double-side drive mode of the data line can be avoided, and the increase of the manufacturing cost and the space occupation can be avoided; it is also possible to use a data line with double-sided driving architecture; in the double-sided driving architecture, the pixel is located at the farther place of the two-side data driving chip 140, and the lightness of the pixel is still dark. By using the method of the present application, the phenomenon can be avoided, and the number and difficulty of dividing the charging areas can be reduced by adopting the data line double-sided driving architecture, and the computational difficulty and the demand of the gamma circuit can be reduced. When the data driving chip is set on one side, the gamma voltage at the far end of the data line is larger. When the data driving chips are set on both sides, the gamma voltage of the charging area corresponding to the middle of the data line is the largest.

Of course, taking the display panel as an example, with the viewer as the center, the first side is an upper side of the display panel, and the second side is the lower side of the display panel; in addition, those skilled in the art may set the first side as the lower side of the display panel and the second side as the upper side of the display panel as needed.

In an embodiment, the farther the charging area is away from the data driving chip 140, the larger the corresponding gamma voltage is.

In the scheme, if the charging area is farther from the data driving chip 140, the standard gamma voltage loss generated by the data driving chip 140 is greater due to the increase in the distance of the resistance of the charging area, and thus the lightness of the charging area is darker as the charging area is farther from the data driving chip 140; an actual gamma voltage with a greater difference than the standard gamma low voltage is applied, so that more voltage compensation can be obtained for a charging area farther from the data driving chip 140 and having a high loss, and less voltage compensation can be obtained for a charging area farther from the data driving chip 140 and having a low loss. In this way, the lightness difference between the charging areas can be reduced and even be eliminated. In other words, if the difference from the standard gamma voltage is larger, that is, the gamma voltage in the charging area closest to the data driving chip 140 corresponds to the standard gamma voltage; in order to cancel the loss of the gamma voltage, when the farther charging area has a larger gamma voltage, the increase magnitude corresponds to the degree of loss.

In an embodiment, the display area of the display panel 100 is sequentially divided into a plurality of charging areas according to the number of rows of data lines, and each charging area has a unique digital code.

In this scheme, each charging area has a unique digital code. When the gamma voltage generation circuit 122 outputs the gamma voltage for drive, one charging area corresponds to only one gamma voltage, which ensures that the gamma voltage generation circuit generates gamma voltages for accurate voltage compensation for each of the charging areas so that the lightness difference between the respective charging areas of the display panel 100 is reduced or eliminated.

In an embodiment, the step of detecting a charging area where the pixel to be charged is located, and outputting a corresponding digital code according to the charging area by a timing control chip 110 includes:

the number of rows of counting data lines of the counter 111 of the timing control chip 110;

the timing control chip 110 identifies the count value of the counter 111, and obtains and outputs the corresponding digital code from the memory.

In the scheme, the timing control chip 110 includes a row counter 111. Since the principle of the row counter 111 is to count X plus 1 for each row charged, and the distance between the corresponding pixel and the data driving chip 140 varies with the number of rows of the scan lines, the distance between the pixel and the data driving chip 140 can be expressed by the number of rows. In this way, we can design the control mode when the count X is different values according to the requirements. Specifically, for example, we can divide the count X into four steps: 100, 200, 300 and 400; if the row value X is less than or equal to 100, the corresponding digital code 1 (1.1 times the standard gamma voltage) is obtained; if the row value X is greater than or equal to 100 and less than or equal to 200, the corresponding digital code 2 (1.2 times the standard gamma voltage) is obtained; if the row value X is greater than or equal to 200 and less than or equal to 300, the corresponding numeric code 3 (1.3 times the standard gamma voltage) is obtained; if the row value X is greater than or equal to 300 and less than or equal to 400, a numeric code 4 (1.4 times the standard gamma voltage) is obtained. By analogy, there are also four sets of digital codes of different sizes, and the gamma voltage corresponding to each set of digital codes increases in turn; of course, for example, when the reference voltage is equal to the operating voltage multiplied by the digital code, the digital code may also be scaling factor values such as 0.5, 0.55 and 0.6 respectively.

The detection and control circuit of the timing control chip 110 recognizes the count value of the row counter 111, and transmits the corresponding digital code to the gamma chip 120 according to the count value. The gamma chip 120 generates gamma voltages according to the digital code to charge the corresponding charging area according to the digital code, and improves the lightness difference of the different charging areas; in addition, each set of digital codes may include and correspond to a plurality of gamma voltages, and gamma voltages can be adjusted precisely for distant and proximal charging areas.

In addition, a detection and control circuit is added to the timing control chip 110 to recognize the different sizes of the X of the row counter 111 and make corresponding different outputs.

In an embodiment, the timing control chip 110 can be a timing control chip; the gamma chip 120 can be a gamma chip; the gamma voltage division coefficient memory 123 can be a gamma voltage division coefficient memory; the operating voltage circuit 130 can be an operating voltage circuit; the data driving chip 140 can be a data driving chip.

Figure 2:
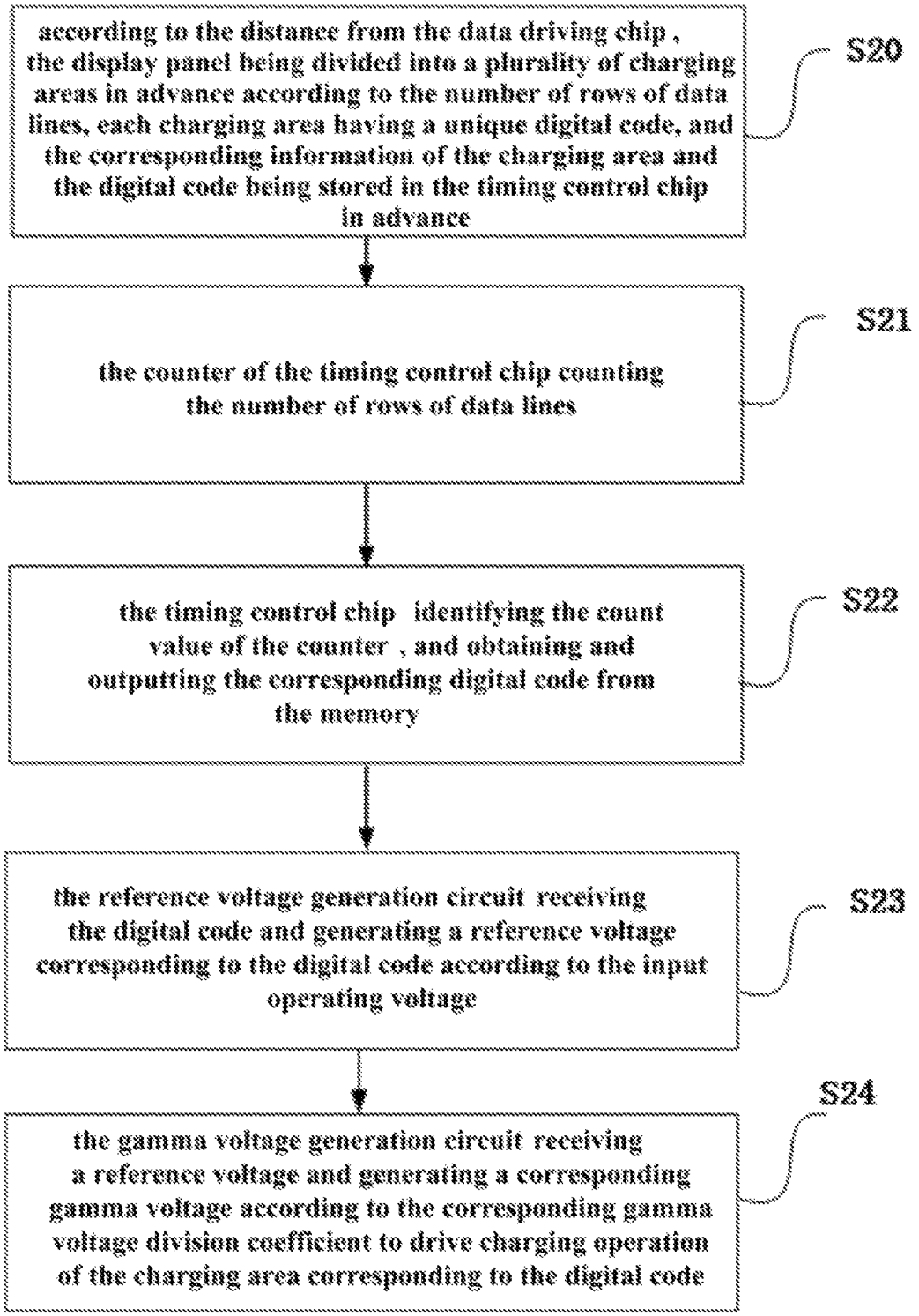
FIG. 2 is a specific schematic diagram of a driving method flow of a display panel in an embodiment of the present application.
Figure 3:
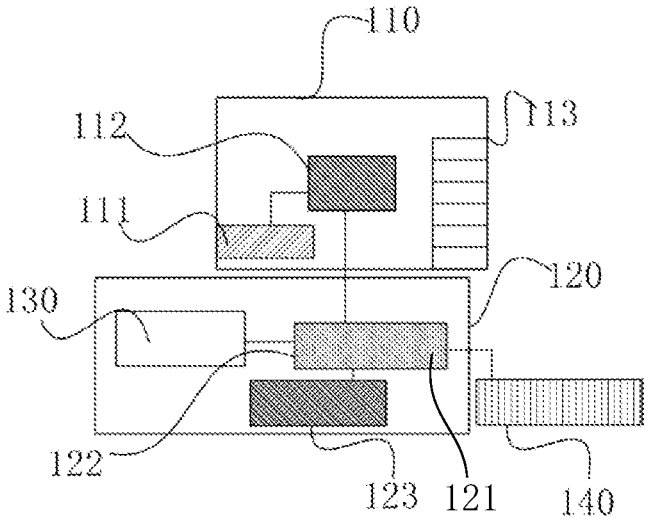
FIG. 3 is a structural schematic diagram of a display panel in an embodiment of the present application.
Figure 4:
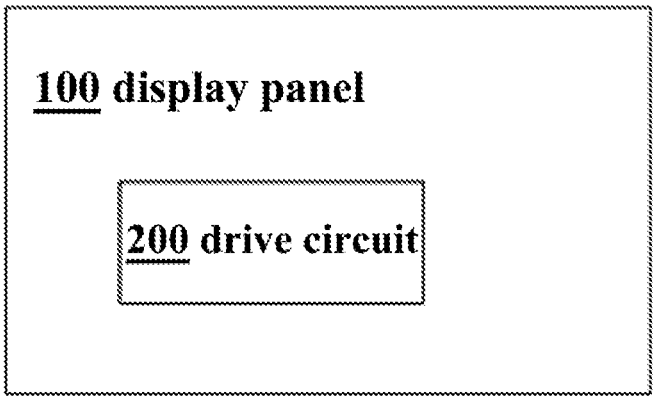
FIG. 4 is a schematic diagram of a drive circuit of a display panel in an embodiment of the present application.

As shown in FIG. 2, as an embodiment of the present application, it discloses a driving method of a display panel 100, including:

S20: according to the distance from the data driving chip 140, the display panel being divided into a plurality of charging areas in advance according to the number of rows of data lines, each charging area having a unique digital code, and the corresponding information of the charging area and the digital code being stored in the timing control chip 110 in advance;

S21: the counter 111 of the timing control chip 110 counting the number of rows of data lines:

S22: the timing control chip 110 identifying the count value of the counter 111, and obtaining and outputting the corresponding digital code from the memory 111;

S23: the reference voltage generation circuit 121 receiving the digital code and generating a reference voltage corresponding to the digital code according to the input operating voltage;

S24: the gamma voltage generation circuit 122 receives a reference voltage and generates a corresponding gamma voltage according to the corresponding gamma voltage division coefficient to drive charging operation of the charging area corresponding to the digital code.

In the drive circuit of the scheme, through the timing control chip 110, the digital code is output to the gamma chip 120 according to the corresponding charging area, the gamma chip 120 further controls the voltage at which the input operates to generate the corresponding reference voltage, and the reference voltage serves as a basis for generating the gamma voltage of the gamma chip 120; the gamma voltage stores a large number of gamma voltage division coefficients. By performing voltage division processing in the gamma chip, the gamma voltage of the charging area can be adjusted and the operation of the processing data of the timing control chip 110 can be reduced. The memory space of the timing control chip 110 can be saved, and the manufacturing cost of the display panel can be further reduced.

In an embodiment, as shown in FIGS. 1 to 4, it discloses a drive circuit 200 of a display panel 100 and the method for using the above drive circuit.

It should be noted that, the limitation of the steps involved in this scheme, without affecting the implementation of the specific scheme, it is not determined to limit the sequence of steps, and the previous steps may be executed first, later, or even simultaneously, and shall be deemed to fall within the scope of the present application as long as the scheme can be implemented.

The technical scheme of the present application can be widely used in various display panels, such as Twisted Nematic (TN) display panels, In-Plane Switching (IPS) display panels, Vertical Alignment (VA) display panels and Multi-Domain Vertical Alignment (MVA) display panels, and, of course, other types of display panels, such as Organic Light-Emitting Diode (OLED) display panels.

The above content is a detailed description of the present application in conjunction with specific alternative embodiments, and it is not to be construed that specific embodiments of the present application are limited to these descriptions. For those of ordinary skill in the art to which this application belongs, a number of simple derivations or substitutions may be made without departing from the spirit of this application, all of which shall be deemed to fall within the scope of this application.

What is claimed is:

1. A driving method of a display panel, comprising:

depending on a distance from a data driving chip, dividing the display panel into a plurality of charging regions in advance, assigning each charging region with a unique digital code, and storing a correspondence between each charging region and the respective digital code in a timing control chip in advance;

detecting a charging region where each pixel to be charged is located, and outputting a corresponding digital code according to the charging region by the timing control chip; and receiving, by a gamma chip, the digital code and generating a gamma voltage corresponding to the digital code based on an input operating voltage to drive a charging operation of the charging region corresponding to the digital code;

wherein the display panel further comprises an operating voltage circuit configured to generate the operating voltage; the gamma chip comprises a reference voltage generation circuit and a gamma voltage generation circuit: wherein an input terminal of the reference voltage generation circuit is connected to the timing control chip and to the operating voltage circuit, and wherein an input terminal of the gamma voltage generation circuit is connected to the reference voltage generation circuit;

wherein the operation of receiving by the gamma chip the digital code from the timing control chip and generating a gamma voltage corresponding to the digital code based on an input operating voltage to drive a charging operation of the charging region corresponding to the digital code comprises: receiving, by the reference voltage generation circuit, the digital code from the timing control chip and generating a reference voltage corresponding to the digital code based on the input operating voltage;

wherein the driving method further comprises the following operations subsequent to the operation of receiving by the reference voltage generation circuit the digital code from the timing control chip and generating a reference voltage corresponding to the digital code based on the input operating voltage; receiving, by the gamma voltage generation circuit, the reference voltage and generating a gamma voltage corresponding to the digital code to drive the charging operation of the charging region corresponding to the digital code;

wherein the driving method further comprises the following operations subsequent to the operation of receiving by the gamma voltage generation circuit the reference voltage and generating a gamma voltage corresponding to the digital code to drive the charging operation of the charging region corresponding to the digital code; receiving, by the reference voltage generation circuit, the digital code from the timing control chip and multiplying the operating voltage by the digital code to obtain the reference voltage.

2. The driving method of a display panel according to claim 1, further comprising the following operations subsequent to the operation of receiving by the reference voltage generation circuit the digital code from the timing control chip and multiplying the operating voltage by the digital code to obtain the reference voltage:

receiving, by the gamma voltage generation circuit, the digital code and generating the gamma voltage corresponding to the digital code based on the reference voltage.

3. The driving method of a display panel according to claim 1, wherein the gamma chip further comprises a gamma voltage division coefficient memory configured to store gamma voltage division coefficients.

4. The driving method of a display panel according to claim 3, wherein the operation of receiving by the gamma voltage generation circuit a reference voltage and generating a gamma voltage corresponding to the digital code to drive the charging operation of the charging region corresponding to the digital code comprises:

receiving, by the gamma voltage generation circuit, the reference voltage and generating the corresponding gamma voltage according to the corresponding gamma voltage division coefficient to drive the charging operation of the charging region corresponding to the digital code.

5. The driving method of a display panel according to claim 1, wherein a first side and a second side of the display panel are each provided with a data driving chip, which adopts a data line double-sided driving mode.

6. The driving method of a display panel according to claim 1, wherein only a first side or a second side of the display panel is provided with a data driving chip, which adopts a data line single-sided driving mode.

7. The driving method of a display panel according to claim 1, wherein the farther the charging region is away from the data driving chip, the larger the corresponding gamma voltage is.

8. The driving method of a display panel according to claim 1, wherein the display area of the display panel is sequentially divided into a plurality of charging regions according to the number of rows of data lines.

9. The driving method of a display panel according to claim 8, wherein each of the charging regions has a unique digital code.

10. The driving method of a display panel according to claim 1, wherein the operation of detecting a charging region where each pixel to be charged is located and outputting a corresponding digital code according to the charging region by the timing control chip comprises:

counting, by counter of the timing control chip, a number of rows of data lines.

11. The driving method of a display panel according to claim 10, wherein counting by a counter of the timing control chip a number of rows of data lines comprises:

identifying, by the timing control chip, a count value of the counter, and obtaining and outputting the corresponding digital code from the memory.

12. The driving method of a display panel according to claim 10, wherein in response to the count value of the counter being greater than or equal to 100 and less than or equal to 200, obtaining a digital code 2 corresponding to 1.2 times standard gamma voltage.

13. The driving method of a display panel according to claim 10, wherein in response to the count value X of the counter being greater than or equal to 200 and less than or equal to 300, obtaining a digital code 3 corresponding to 1.3 times standard gamma voltage is obtained.

14. The driving method of a display panel according to claim 10, Wherein in response to the count value X of the counter being greater than or equal to 300 and less than or equal to 400, obtaining a digital code 4 corresponding to 1.4 times standard gamma voltage.

15. A driving method of a display panel, comprising:

depending on a distance from a data driving chip, dividing the display panel into a plurality of charging regions in advance based on a number of rows of data lines, each charging region being assigned with a unique digital code, and storing a correspondence between each charging region and the respective digital code in a timing control chip in advance;

counting, by a counter of the timing control chip, a number of rows of data lines;

identifying, by the timing control chip, a count value of the counter, and obtaining and outputting the corresponding digital code from the memory;

receiving, by reference voltage generation circuit, the digital code from the tuning control chip, and generating a reference voltage corresponding to the digital code based on an input operating voltage of an operating voltage circuit; and receiving, by a gamma voltage generation circuit, a reference voltage and generating a corresponding gamma voltage based on a corresponding gamma voltage division coefficient to drive a charging operation of the charging region corresponding to the digital code;

wherein the farther the charging region is away from the data driving clip, the larger the corresponding gamma voltage is.

16. A driving circuit of a display panel using a driving method that comprises:

depending on a distance from a data driving chip, dividing the display panel into a plurality of charging regions in advance, assigning each charging region with a unique digital code, and storing a correspondence between each charging region and the respective digital code in a timing control chip in advance;

detecting a charging region where each pixel to be charged is located, and outputting a corresponding digital code according to the charging region by a timing control chip; and receiving, by a gamma chip, the digital code and generating a gamma voltage corresponding to the digital code based on an input operating voltage to drive a charging operation of the charging region corresponding to the digital code;

wherein the display panel further comprises an operating voltage circuit configured to generate the operating voltage; the gamma chip comprises a reference voltage generation circuit and a gamma voltage generation circuit; wherein an input terminal of the reference voltage generation circuit is directly connected to the timing control chip and to the operating voltage circuit, and wherein an input terminal of the gamma voltage generation circuit is connected to the reference voltage generation circuit;

wherein the operation of receiving by the gamma chip the digital code from the timing control chip and generating a gamma voltage corresponding to the digital code based on an input operating voltage to drive a charging operation of the charging region corresponding to the digital code comprises: receiving, by the reference voltage generation circuit, the digital code from the timing control chip and generating a reference voltage corresponding to the digital code based on the input operating voltage;

wherein the driving method further comprises the following operations subsequent to the operation of receiving by the reference voltage generation circuit the digital code from the timing control chip and generating a reference voltage corresponding to the digital code based on the input operating voltage; receiving, by the gamma voltage; generation circuit, the reference voltage and generating a gamma voltage corresponding to the digital code to drive the charging operation of the charging region corresponding to the digital code;

wherein the driving method further comprises the following operations subsequent to the operation of receiving by the gamma voltage generation circuit the reference voltage and generating a gamma voltage corresponding to the digital code to drive the charging operation of the charging region corresponding to the digital code; receiving, by the reference voltage generation circuit, the digital code from the timing control chip and multiplying the operating voltage by the digital code to obtain the reference voltage.

* * * * *